US007384382B2

(12) United States Patent
Farrah et al.

(10) Patent No.: US 7,384,382 B2
(45) Date of Patent: Jun. 10, 2008

(54) INTERPERSONAL TOWING SYSTEM

(75) Inventors: Theresa M. Farrah, Millbrae, CA (US); Eric Bone, Seattle, WA (US)

(73) Assignee: Meridian Geographics, LLC, Seattle, WA (US)

( * ) Notice: Subject to any disclaimer, the term of this patent is extended or adjusted under 35 U.S.C. 154(b) by 357 days.

(21) Appl. No.: 11/129,723

(22) Filed: May 13, 2005

(65) Prior Publication Data

US 2005/0252717 A1 Nov. 17, 2005

Related U.S. Application Data

(60) Provisional application No. 60/571,156, filed on May 15, 2004.

(51) Int. Cl.
*A63B 21/02* (2006.01)
*A63B 71/00* (2006.01)

(52) U.S. Cl. ..... 482/124; 273/453

(58) Field of Classification Search ..... 482/121–128; 472/133; 273/453; 119/770; 434/253, 247, 434/250, 255; 473/464
See application file for complete search history.

(56) References Cited

U.S. PATENT DOCUMENTS 3,458,188 A * 7/1969 Infante ..... 472/133
3,486,671 A * 12/1969 Sanders ..... 224/576
3,789,431 A * 2/1974 Rand ..... 2/236
4,214,382 A * 7/1980 Matsutani ..... 434/247
4,445,866 A * 5/1984 Cillieres ..... 434/253
4,667,624 A * 5/1987 Smith ..... 119/770
4,997,860 A * 3/1991 Kabeta ..... 523/144
5,165,696 A * 11/1992 Saha ..... 473/459
5,205,803 A * 4/1993 Zemitis ..... 482/121
5,289,590 A * 3/1994 Larson ..... 2/227
5,316,533 A * 5/1994 Hoker ..... 482/121
5,636,387 A * 6/1997 Lundy ..... 2/408
5,689,832 A * 11/1997 Head ..... 2/227
5,718,189 A * 2/1998 Blake ..... 119/770
5,733,231 A * 3/1998 Corn et al. ..... 482/120
5,746,672 A * 5/1998 Smith ..... 473/464
5,806,087 A * 9/1998 Grotefend ..... 2/1
5,881,392 A * 3/1999 Koerner et al. ..... 2/227
6,015,073 A * 1/2000 Wojciak et al. ..... 224/251
6,099,447 A * 8/2000 Ramsaroop ..... 482/127
6,105,169 A * 8/2000 Colorado ..... 2/81
6,202,220 B1 * 3/2001 Rhoden ..... 2/236
6,256,789 B1 * 7/2001 Young et al. ..... 2/69
6,327,714 B1 * 12/2001 Koerner ..... 2/236
6,481,528 B2 * 11/2002 Antonio ..... 182/6
6,490,733 B1 * 12/2002 Casaubon ..... 2/81
6,651,594 B1 * 11/2003 Bagwell ..... 119/770
6,658,666 B2 * 12/2003 Schweer ..... 2/94
D495,853 S * 9/2004 Nelson ..... D2/627

(Continued)

*Primary Examiner*—Fenn C. Mathew
*Assistant Examiner*—Allana Lewin
(74) *Attorney, Agent, or Firm*—Edward S. Sherman, Esq.

(57) ABSTRACT

An interpersonal towing system deploys two or more harnesses each worn by an individual, each harness connected to opposing sides of a highly elastic towline that is protected by a durable fabric cover. The harnesses are configured for detachable connection to the towline via a pair of loops or rings fixed at upper pelvis level at both the front and rear of each harness. The system is suitable for either person assisting the other to traverse difficult terrain with great efficiency yet without damaging the highly elastic towline.

15 Claims, 16 Drawing Sheets

U.S. PATENT DOCUMENTS

| | | | | |
|---|---|---|---|---|
| 6,851,393 | B2 * | 2/2005 | Bremm | 119/770 |
| 6,922,849 | B1 * | 8/2005 | Fedrick | 2/227 |
| 6,962,232 | B2 * | 11/2005 | Diggle et al. | 182/6 |
| 7,017,525 | B2 * | 3/2006 | Leach | 119/770 |
| 7,047,567 | B2 * | 5/2006 | Allen | 2/69 |
| 2002/0042942 | A1 * | 4/2002 | Colorado | 2/230 |
| 2002/0074185 | A1 * | 6/2002 | Colorado | 182/6 |
| 2003/0146044 | A1 * | 8/2003 | Jordan | 182/3 |
| 2004/0163159 | A1 * | 8/2004 | Edwards et al. | 2/338 |
| 2004/0250331 | A1 * | 12/2004 | Bayer | 2/69 |
| 2006/0206986 | A1 * | 9/2006 | Straiton | 2/238 |

* cited by examiner 820
836a
840a
C
C'
825
835
836b
840b
D
D'

INTERPERSONAL TOWING SYSTEM

CROSS REFERENCE TO RELATED APPLICATIONS

This application claims priority to the provisional patent application for an "Interpersonal Towing System", filed on May 15, 2004, having Ser. No. 60/571,156, which is incorporated herein by reference.

BACKGROUND OF INVENTION

The present invention relates to sporting goods and in particular to an interpersonal towing system.

In various group sports or outdoor endeavors it is desirable to attach one person to another with a rope or cord such that one participant can assist the other in movement by urging the connecting rope or cord forward, such as by advancing forward.

However, such towing ropes or cords can be a hindrance, exerting an excessive and immediately restoring force when any slack in the cord is removed.

It is desirable and known in the art to use linear elastic members to connect two or more people together.

However, the previously deployed methods of using or attaching a linear elastic member as an interpersonal towing system can be tedious, cumbersome, uncomfortable and unreliable.

Accordingly, it is an object of the invention to provide an improved inter-personal towing system that includes various components to overcome the deficiencies known in the art.

SUMMARY OF INVENTION

In the present invention, this object is achieved by providing an interpersonal towing system that allows one or more individuals to tow one or more other individuals. The system includes a first harness, with front and rear towline connection loops, a second harness, with front and rear towline connection loops, wherein the first and second harnesses are interconnected by a highly elastic towline. The highly elastic towline is connected to the rear connection loop of one harness and the front connection loop of the other harness by a detachable coupling at each end.

More generally, the system allows one or more typically stronger individuals (leaders), traveling on foot, to apply their energy toward the forward motion of one or more typically weaker individuals (followers), allowing the entire group to travel together. A leader and follower may exchange roles by detaching the elastic towline and reversing positions.

An aspect of the invention is characterized in that the harness is configured to stabilize the position of the front and rear connection loops at upper pelvis level.

The above and other objects, effects, features, and advantages of the present invention will become more apparent from the following description of the embodiments thereof taken in conjunction with the accompanying drawings.

DETAILED DESCRIPTION

Figure 1A:
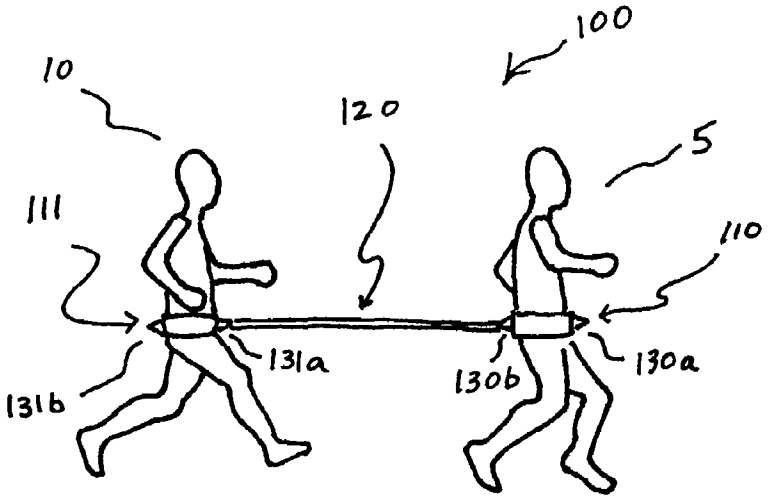
FIG. 1A is a schematic illustration showing an interpersonal towing system in use, wherein one person assists another person.

Referring to FIGS. 1 through 13, wherein like reference numerals refer to like components in the various views, there is illustrated therein a new and improved interpersonal towing system generally denominated 100 herein.

In accordance with the present invention, FIG. 1 illustrates the use of the towline and harness system. Towing system 100 comprises a pair of harnesses 110 and 111 worn respectively by a leader 5, who is walking or running with or optionally towing follower 10. To the extent that the pace of the leader 5 is greater than the follower, towline 120 will stretch and exert a force that urges the follower 10 forward, assisting them to move at the same speed as leader 5 without significantly greater exertion. The towline 120 is connected to the rear of the leader's harness 110 at rear connection loop 130*b* and the front of the follower's harness 111 at front connection loop 131*a*. As a typical outing or competition may include several different physical activities such as walking, running, skiing, and roller skating, and as any individual may be strong in some activities but weak in others, the roles of leader 5 and follower 10 are easily changed by detaching the ends of the towline from each person's harness and reconnecting them, that is connecting one end of towline 120 to the front connection loop 130*a* of harness 110 and the other end of towline 120 to the rear connection loop 131*b* of harness 111. In various preferred embodiments, to be more fully described below, the harness is configured to stabilize the position of the front and rear connection loops at upper pelvis level.

In particular, the high elasticity of towline 120 permits one person to tow the other through a variety of difficult terrains. Thus, the systems in the various embodiments of the invention can be used when people of differing strengths wish to travel together without requiring the stronger people to proceed with less effort than they would like and/or the weaker people to proceed with greater effort than they would like. Such systems can also be used to tow people who are fatigued or injured.

These systems are particularly useful to participants in team adventure sports. They are also useful to runners of different abilities who wish to train together, to hikers of different abilities wishing to go on an outing together, to cross country skiers skiing together, and to blind people with sighted guides. In particular, the highly elastic towline allows a much smoother connection between leader and follower than a non-elastic towline. With a non-elastic line, there is either tension on the line or not. With an elastic line, a wide range of tension is possible, allowing variations in speed and/or effort without introducing slack into the line or jerking the follower forward.

Figure 1B:
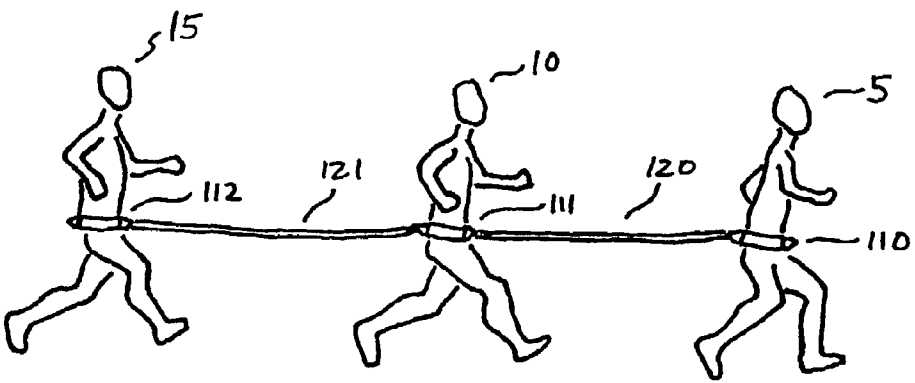
FIG. 1B is a schematic illustration showing an interpersonal towing system in use, wherein one person may assist one or two people, or two people may jointly assist a third person.

FIG. 1B illustrates another embodiment of a method of using the towing system of FIG. 1A, in which a second follower 15, wearing harness 112, is now attached by a second towline 121 to the harness of the first follower 10. In this configuration, leader 5 can pull the first follower 10 or both the first follower 10 and the second follower 15, or the first follower 10 can the pull second follower 15.

Figure 4A:
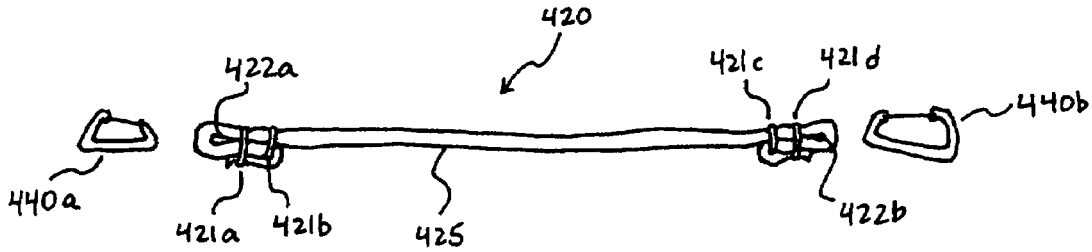
FIG. 4A is another perspective illustration of the embodiment of a coupling and the towline illustrated in FIG. 2.
Figure 4B:
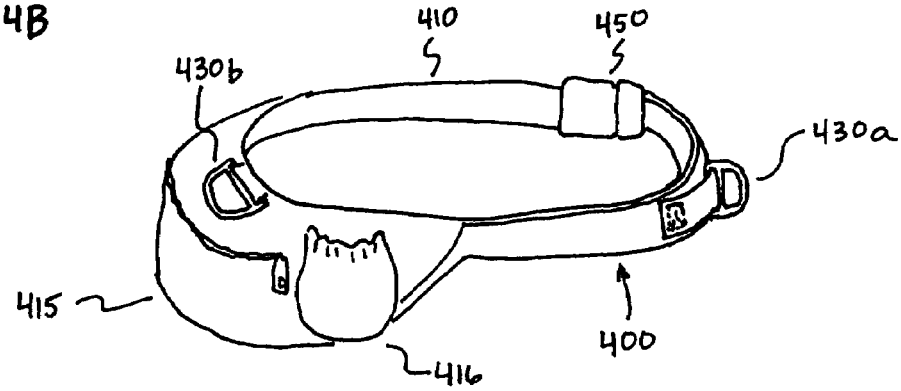
FIG. 4B is a perspective illustration of another embodiment of a harness for use with the inventive towline system.

FIG. 4A is a perspective illustration of one embodiment of a coupling and the towline. Towline 420 is formed from a length of surgical elastic tubing 425. Cable ties 421*a* and 421*b* are used at the first end of the elastic tubing 425 to create a first loop portion 422*a* for insertion into carabiner clip 440*a*, whereas cable ties 421*c* and 421*d* are used on the opposing end of the elastic tubing 425 to create a second loop portion 422*b* for insertion into carabiner clip 440*b*. Layers of thin rubber sheeting may be used to protect the elastic tubing 425 from the sharp edges of the cable ties 421*a-d*. It will be appreciated by those skilled in the art that there are many common means of securely attaching the end of a length of surgical tubing to a carabiner clip, spring clip, spring hook, cord hook, snap hook, or the like, and any of these means may be used in the present invention. FIG. 4B is a perspective illustration of another embodiment of a harness for use with the inventive towing system. Waist pack style harness 400 comprises a waistband portion 410 joined by buckle 450. The waistband portion 410 is connected to the pouch portion 415 that bears storage pouch 416. It should be understood that any of the backpacks or waist packs that are integrated with a harness include or form the storage pouch for the towline, as well as storing other items of use to the leader/follower. D-rings 430*a* and 430*b* are connected to the front and rear of waist pack style harness 400 respectively, for connecting the towline thereto as described with respect to the previous figures.

Figure 2:
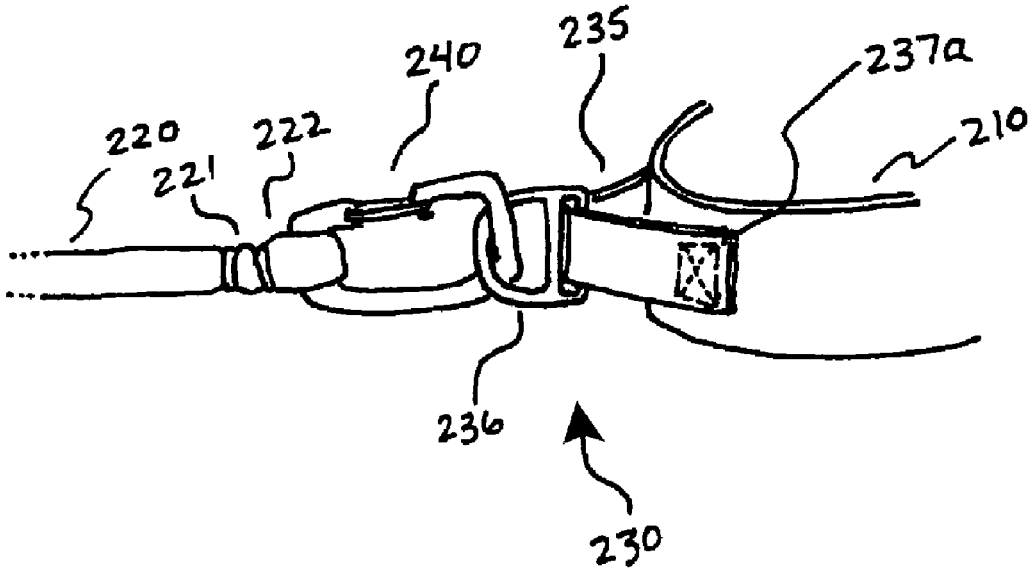
FIG. 2 is a perspective illustration of one embodiment of the coupling between the harness and the towline.

In a preferred embodiment of the invention, the towline is rapidly detachable from the harness of each participant to provide for the rapid exchange of roles of leader and follower, or to unclip for rugged or downhill terrain, or because towing is no longer needed or desired. Accordingly, FIG. 2 illustrates in perspective an embodiment wherein a highly elastic line 220 is connected to a connection loop 235 of harness 210. A carabiner clip passes through each of the harness connection loop 230 and the loop 222 formed at the end of elastic line 220 via fastener 221, providing a rapidly detachable but strong and secure connection. It should be understood that a carabiner clip is just one style or type of latching clip that is preferably deployed in various embodiments of the invention. Alternatives to a carabiner clip include a spring clip, spring hook, cord hook, snap hook and the like. The connection loop on each harness preferably terminates in a strong metal, "NYLON", synthetic plastic, or plastic ring more preferably a D-ring, and most preferably a 1" slotted D-ring 236, which is permanently secured to harness 210 by a securement loop, such as strap 235. The securement loop is preferably a 2" length of 1" wide "NYLON" fabric webbing, passing through the slot of the D-ring and sewn to harness 210 at overlapping portions 237*a* and 237*b* (not shown). Thus, the D-ring is readily inserted into or removed from carabiner clip 240 to disconnect elastic line 220 from harness 210. The loop of elastic tubing 222 at the end of elastic line 220 also is inserted into the carabiner clip 240, or any alternative latching clip. Further embodiments of the invention provide alternative methods of forming elastic line 220, and in particular, in the more preferred embodiments, elastic surgical tubing of natural latex rubber with an outer diameter of 0.5 inches and an inner diameter of 0.25 inches is used for all or part of the line.

The clip-in harnesses of FIG. 1 and FIG. 2 offer great convenience to both the leader and follower, as the towline is readily connected to the part of the body, generally the upper pelvis, where force is most efficiently applied or exerted on the persons so interconnected.

Figure 3A:
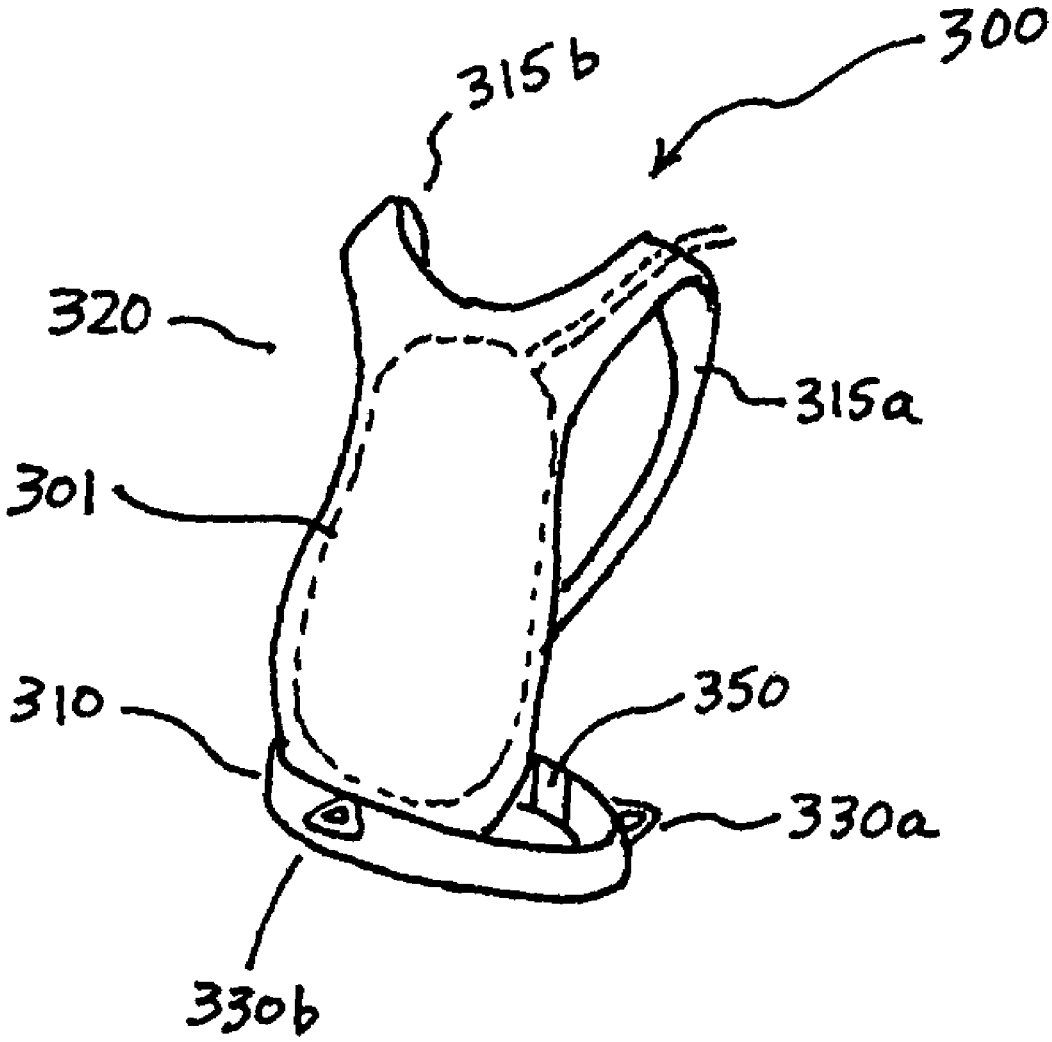
FIG. 3 is a perspective illustration of a first embodiment of a harness integrated with a backpack for use with the inventive towline system.
FIG. 3B illustrates an alternative and preferred embodiment of a harness system configured as a backpack
FIG. 3C is a fragmentary view showing details of the rear D-ring 330*b* and its attachment to the backpack 302.
FIG. 3D is a fragmentary view showing details of the front D-ring 330*a*

FIG. 3A is a perspective illustration of another embodiment of the invention wherein the harness is integrated with a backpack, which optionally includes an integrated flexible water storage container or so called hydration pack 301. In other embodiments of the harness, more fully described below, a waist pack or pouch may be integrated.

As shown in the perspective illustration in FIG. 3A, a harness system 300 comprises a backpack component 320 having shoulder straps 315*a* and 315*b*, as well as hip belt 310. Hip belt 310 closes via buckle assembly 350. D-rings 330*a* and 330*b* are connected to the front and rear of hip belt 310 respectively, for connecting the towline thereto as described with respect to the previous figures.

It should be appreciated that by integrating the harness with a backpack or hydration pack that already attaches to the user's shoulders and hips, the contents of the pack exerts a downward force preventing the hip belt from riding up. Accordingly, the variable impact of the load or force from the other person interconnected therewith does not destabilize the position of the harness connection point with respect to the user's body, that is the connection is retained at upper pelvis level. As will be further described with respect to other embodiments of the invention, a similarly stabilized harness may be successfully integrated with waist pack or hip belt by including anti-slip material on the inner surface, or an elastic fabric panel to wrap around the user's hips.

Figure 3B:
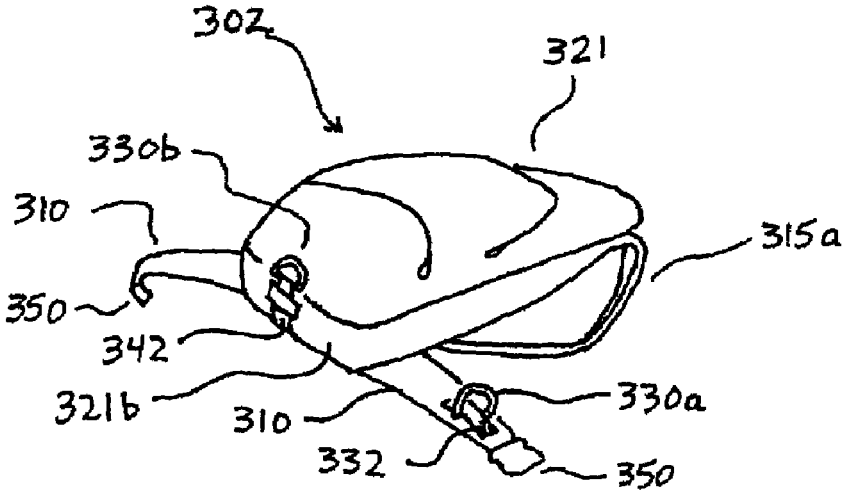

FIG. 3B illustrates an alternative and preferred embodiment of a harness system configured as a backpack 302, shown with the back oriented side downward. The backpack harness 302 comprises a sealable pouch 321 attached to shoulder straps 315*a* and 315*b* (not shown), as well as hip belt 310. Hip belt 310 closes via buckle assembly 350 around the user's waist.

Figure 3C:
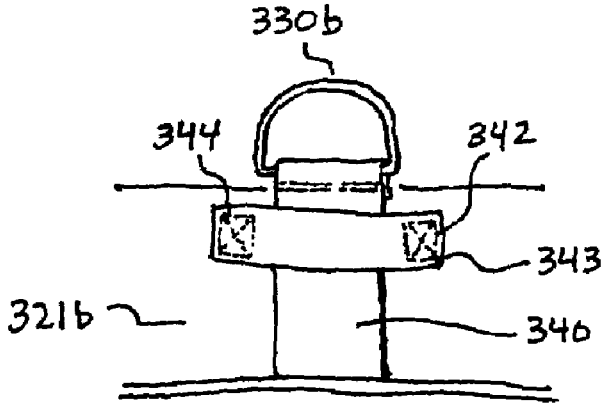

FIG. 3C is a fragmentary view showing details of the rear D-ring 330*b* and its attachment to the backpack 302. D-ring 330*b* is connected to the bottom panel 321*b* of the sealable pouch 321 via tether 340. The tether 340 is preferably a 2" wide "Nylon" fabric webbing is held flat against bottom of the pack body by this 1" webbing strip. Preferably, tether 340 is about 5" long. Specifically, tether 340 is held in place keeping D-ring 330*b* extending outward from outward edge of the bottom and back panel by fabric loop 342, which is fastened to the bottom panel 321*b* of sealable pouch 320. Fabric loop 342 is stitched to the bottom panel 321*b* via the stitching patterns labeled 343 and 344. The end of tether 340 is sewn into the seam between the components that form the pouch or pack body, that is bottom panel 321*b* at the panels that form sealable pouch 321 and/or hip belt 310.

Figure 3D:
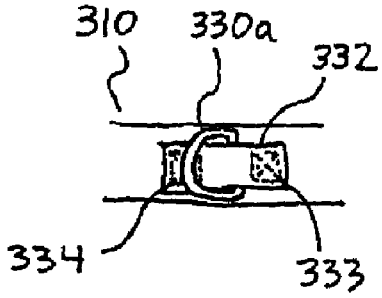

FIG. 3D is a fragmentary view showing details of the front D-ring 330*a*. A D-ring 330*a* is preferably sewn onto front of hip belt 310 using a 1" webbing strip or fabric loop 332, which is fastened to the bottom panel the hip belt 310 via the stitching patterns labeled 333 and 334.

FIG. 4A is a perspective illustration of one embodiment of a coupling and the towline. Towline 420 is formed from a length of surgical elastic tubing 425. Cable ties 421*a* and 421*b* are used at the first end of the elastic tubing 425 to create a first loop portion 422*a* for insertion into carabiner clip 440*a*, whereas cable ties 421*c* and 421*d* are used on the opposing end of the elastic tubing 425 to create a second loop portion 422*b* for insertion into carabiner clip 440*b*. Layers of thin rubber sheeting may be used to protect the elastic tubing 425 from the sharp edges of the cable ties 421*a-d*. It will be appreciated by those skilled in the art that there are many common means of securely attaching the end of a length of surgical tubing to a carabiner clip, spring clip, spring hook, cord hook, snap hook, or the like, and any of these means may be used in the present invention. FIG. 4B is a perspective illustration of another embodiment of a harness for use with the inventive towing system. Waist pack style harness 400 comprises a waistband portion 410 joined by buckle 450. The waistband portion 410 is connected to the pouch portion 415 that bears storage pouch 416. It should be understood that any of the backpacks or waist packs that are integrated with a harness include or form the storage pouch for the towline, as well as storing other items of use to the leader/follower.

Figure 5A:
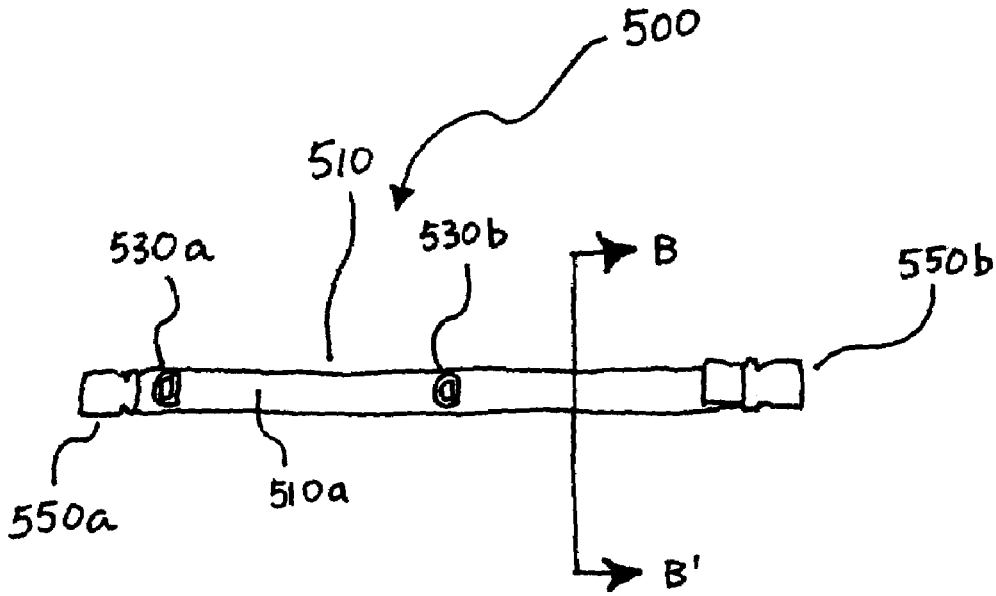
FIG. 5A is a perspective illustration of another embodiment of a harness for use with the inventive towline system.
Figure 5B:
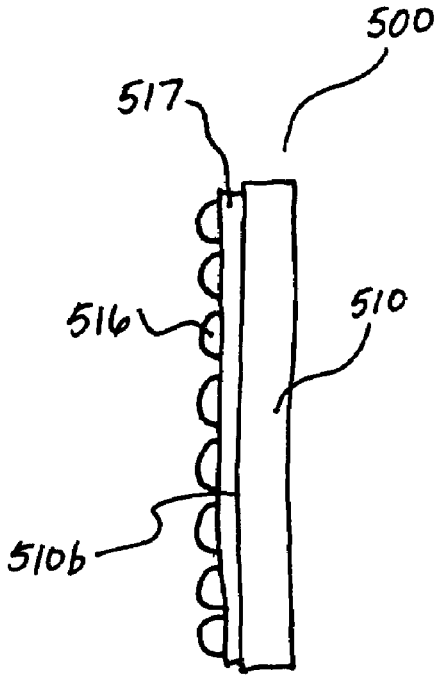
FIG. 5B is a cross-sectional elevation of a portion of the harness of FIG. 5A.

FIG. 5 is a perspective illustration of a harness 500 that deploys another embodiment of the invention, in which a non-slip harness worn at upper pelvis level leads to efficient towing of one person by the other through a variety of difficult terrains. Harness 500 comprises a waist belt portion of flat strapping 510, such as nylon webbing, fabric and the like, preferably 2"wide, and having mating adjustable buckle components 550*a* and 550*b* disposed at opposed ends for securing on the waist of either a leader or a follower. Further, two connection loop members 530*a* and 530*b* are preferably disposed on the outer surface 510*a* of waist belt portion 510. However, a single connection loop is also acceptable, as the leader or follower can easily reverse roles by each loosening the belt at buckle 550 to rotate the belt 180 degrees, thus moving the position of a single loop connection between their front and rear positions. The non-slip function in harness 500 is performed by at least a partial layer of tacky or elastomeric material sewn or attached to the inside surface 510*b* of waistband or belt portion 510, as shown in FIG. 5B corresponding to section line B-B' in FIG. 5A. In this embodiment, the tacky material is preferably a non-woven elastic material having a continuous layer 517 sewn or adhered to the belt surface 510*b*, or forming thin strips woven into strapping 510. The tacky material can also be fabricated from a deformable plastic or elastomer deployed in the mammillated array 516 disposed on the opposite side of continuous layer 517. When belt 510 is tensioned at the user's upper pelvis, by tightening the belt at the adjustable buckle 550, the mammillated protrusions 516 compress to effectively increase the contact area with the user's body or clothing. The resulting strong grip to the user's body or clothing thus prevents the belt 500 from sliding up or down during use. It should be recognized that non-slip components could be combined or integrated into a waist pack style harness shown in FIG. 4.

FIG. 6 is a perspective illustration of yet another embodiment of the invention that embraces a process or method of modifying an article of clothing or a garment to form a harness assembly according to alternative embodiments of the invention. Thus in FIG. 6A, a pants garment 610 is optionally fitted with at least one, but preferably two or four belt loops 630 disposed about the upper pelvis of the user of the towing systems and towlines disclosed herein. Loop 630 is formed by attaching a fabric strip 631 to a garment, preferably pants or shorts, via sewing, or by rivets or grommet assembly.

Figure 6A:
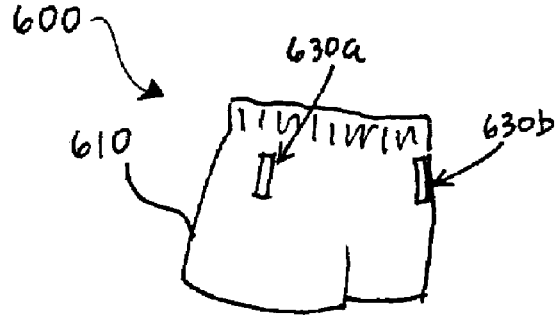
FIG. 6A is a perspective illustration of another embodiment of the invention for retrofitting an article of clothing or sports equipment to form a harness for use with the towline system.
Figure 6B:
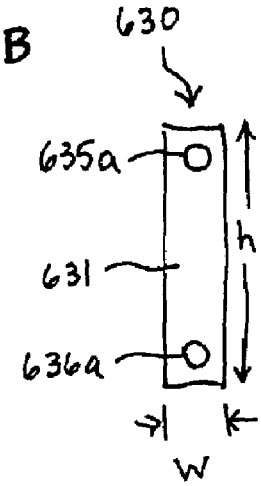
FIG. 6B is an element of one embodiment of a retrofit component for forming a connection loop shown in FIG. 6A
Figure 6C:
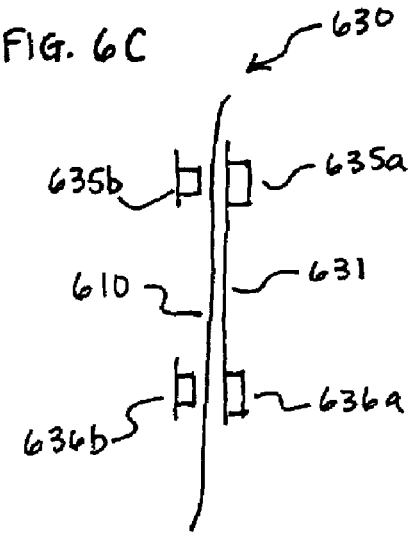
FIG. 6C is a cross-sectional elevation taken orthogonal to the elevation in FIG. 6B illustrating the method of attachment to a garment.

In one embodiment a fabric strip 631 is used to form loop 630, as illustrated in the elevation in FIG. 6B, along with the corresponding orthogonal elevation in cross-section, FIG. 6C. Fabric strip 631 is used to form connection loop 630 and has a width, w, of about 1 inch (25 mm) and a height, h, of about 2.7 inches (69 mm). Fabric strip 631 is preferably secured to garment 610 via mating rivets that secure the fabric of the garment there between. Thus, in FIGS. 6B and 6C, fabric strip 631 has two female rivet members 635*a* and 636*a* disposed at opposing ends. Thus, the insertion of male rivets 635*b* and 636*b* into female rivet member 635*a* and 636*a* from behind or inside the garment effectively clamps a portion of garment 610 between the rivet members, securing fabric strip 631 to form connection loop 630. After insertion the male rivet members are substantially permanently secured into the female rivet members, typically by hammering the male member into the female member.

Thus another embodiment of the invention is a combination of an elastic towline and hip belt 500 with adjustable buckle and D-rings as a kit with the fabric strips and rivets used to form loops 630 in FIG. 6A. It should be appreciated that the kit can be used to retrofit connection loops that include a D-ring, to other types of garments, including sporting equipment such as backpacks, waist packs, hydration backpacks and the like. Thus, such a kit preferably includes two or more D-rings, or at least one D-ring for each fabric strip 631 that is intended for conversion into a connection loop 630.

Figure 6D:
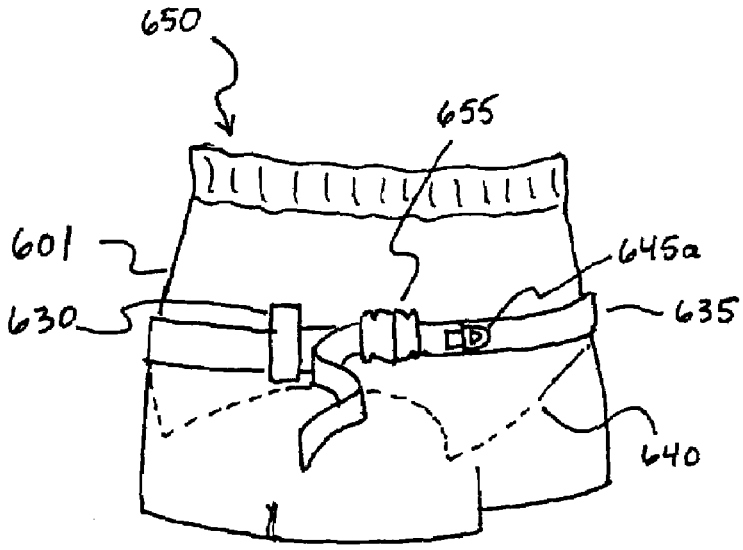
FIG. 6D is a perspective view of another embodiment of a harness configured as lined running shorts.

FIG. 6D is a perspective view of another embodiment of a harness 600 built into clothing, configured as running shorts 601. Running shorts 601 have a typical waistband 650 and inner liner 640, the edge of which is shown in dashed lines. The harness belt 635 is preferably formed of 1½" wide "NYLON" fabric webbing. A first D-ring 645*a* is attached to the center front of the harness belt 635 via a loop of similar webbing, which passes through the D-ring 645*a* prior stitching to harness 635. D-ring 645*a* is disposed adjacent to a plastic buckle 655 that joins opposing ends of harness belt 635. Buckle 655 preferably also allows for adjusting the harness belt 635 length so that it fits different users. The harness belt 635 is held in place at the optimum hip level by belt loops 630 formed of 1 inch wide "NYLON" fabric webbing. Belt loops 630 are also preferably about 2¼" long and are sewn or attached using rivets at each end through both outer fabric of shorts 601 and liner 640. More preferably, belt loops 630 are also sewn or attached using rivets into the side seams on both sides of the shorts 601 so that they traverse both the front and rear fabric panels of the garment. Because the belt loops are attached directly to the liner, a close-fitting inner garment, the harness belt passing through the loops is stabilized on the wearer at the level of the upper pelvis. The harness belt is prevented from riding up because the liner passes through the wearer's crotch. Thus this embodiment of the harness is the most stable on the wearer's body of all embodiments described herein, while also adding the least amount of weight beyond the weight of the wearer's usual clothing.

Figure 7A:
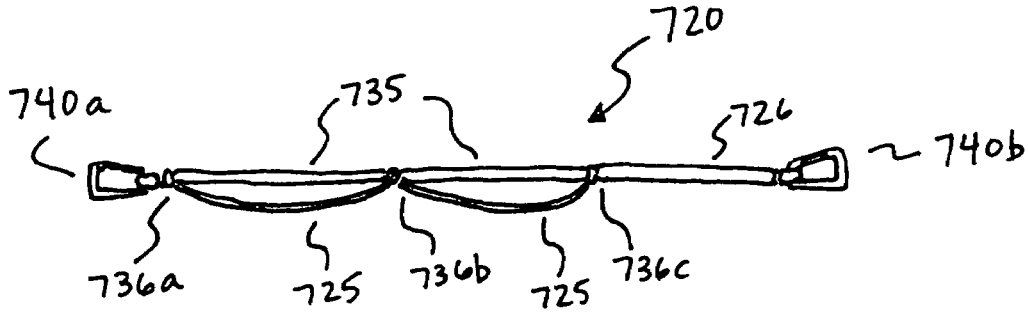
FIG. 7A is a perspective illustration of another embodiment of a towline in a first, extended state.
Figure 7B:
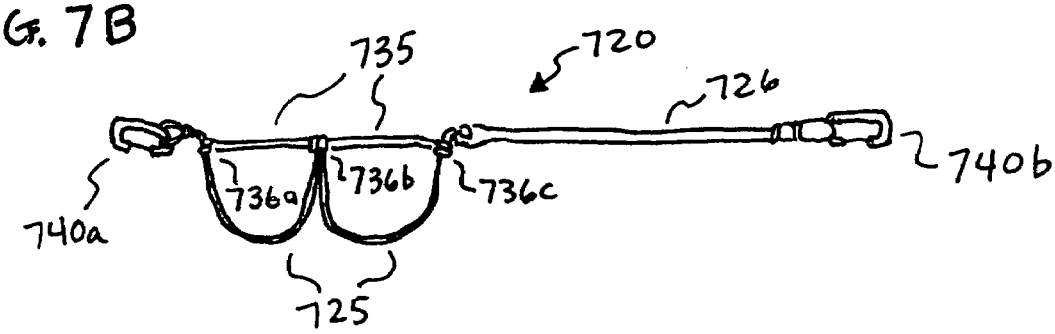
FIG. 7B is a perspective illustration of the towline of FIG. 7A in a second, relaxed state.
Figure 7C:
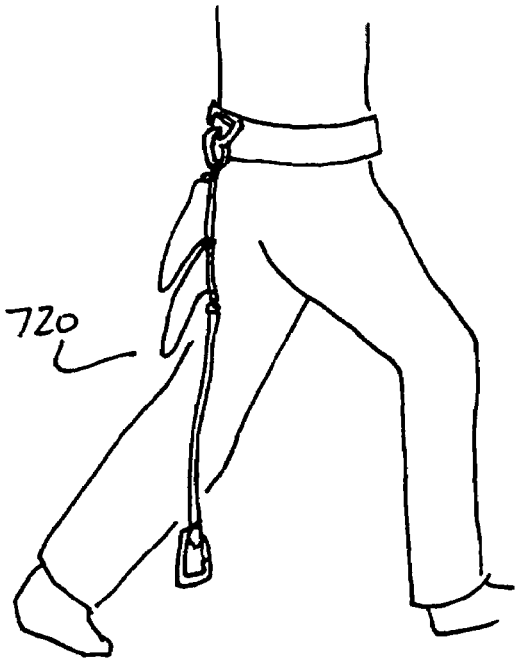
FIG. 7C is a schematic illustration of the towline of FIG. 7A in its relaxed state attached to a harness worn by a person.

In the most preferred embodiment of the invention, the towline is configured for ease of carrying when not in use. Specifically, FIG. 7 illustrates in perspective view a hybrid towline that allows one person to detach the towline from his/her harness without concern for the time and delay in neatly gathering and then stowing the towline 720. FIG. 7A illustrates such a towline 720 under tension, whereas FIG. 7B illustrates towline 720 in the relaxed state. This towline comprises a static segment 725 comprising a length of nonelastic cord, attached end-to-end to a modulating segment 726 comprising length of medium weight surgical tubing. A draw segment 735 comprising short length of lightweight surgical tubing is connected to the cord 725 at multiple connection points 736 *a, b*, and *c*. When tension in line 720 is removed, the draw segment 735 retracts and gathers the segments of the static segment 725 proximal to attachment points 736*a-c*. Note that as an alternative embodiment for securing the towline to the harness assembly, towline 720 includes detachable couplings 740*a* and 740*b* disposed at opposite ends thereof. FIG. 7C illustrates towline 720 in the relaxed state when attached to a harness worn by a person. Towline 720 does not drag on the ground, as it preferably has a length in the relaxed state of less than about 3 feet. Preferably, the static segment is a nylon cord such as that used to tie down tents and tarps, about 42" long, the draw segment is lightweight surgical tubing about 14" long with an outer diameter of 0.25" and an inner diameter of 0.19", and the modulating segment is medium weight surgical tubing of outer diameter 0.5" and inner diameter 0.25", about 21" long. In this embodiment, the towline 720 extends, with very little force, to a length that provides a comfortable following distance, for the draw segment 735 will extend fully under light force. Further force is accommodated by the modulating segment 726, as in the embodiments of the towline described previously. The abbreviated length of medium weight surgical tubing of modulating segment 726 in this embodiment, as compared to previously described embodiments, is sufficient to provide the shock-absorbing benefits of previously described embodiments. A further advantage of this embodiment is that it is lighter weight than embodiments comprising medium weight surgical tubing only, as the combined weight of the static segment 725 and the draw segment 735 is less than the weight of a section of medium weight surgical tubing of the same length as static segment 725.

The high elasticity of the towline, in all embodiments described, smoothly accommodates changes in exertion on the part of any of the participants. Preferably, the surgical tubing used to form the elastic towline is of natural latex rubber with outer diameter 0.5" and inner diameter 0.25". Such surgical tubing has great shock absorbing qualities while not stretching overly much during typical use. It also has the property of being strong enough to withstand the greatest forces that typically would be applied under the invention's intended use. In preferred embodiments the combined towline has a length of less than about 3 feet in the relaxed state but extends to at least about twice its relaxed length, or to at least about 5 to 6 feet, under a light towing force of about 3 kilograms. Thus, when attached to the harnesses of the leader and the follower, the towline allows the leader and the follower to be separated by a comfortable distance of at least about 6 feet under even light towing forces. In these preferred embodiments, the towline has a length of about 8 feet under a moderate towing force of about 12 kilograms, allowing moderate hauling to occur without the follower being separated from the leader by too great a distance.

FIG. 8 illustrates another embodiment of the invention, which includes a protective cover 835. Protective cover 835 surrounds elastic tubing 825, and is preferably attached thereto at attachment points 836*a* and 836*b* located adjacent to detachable couplings 840*a* and 840*b* disposed at opposite ends of towline 820.

Figures 8A, 8B, 8C, 8D:
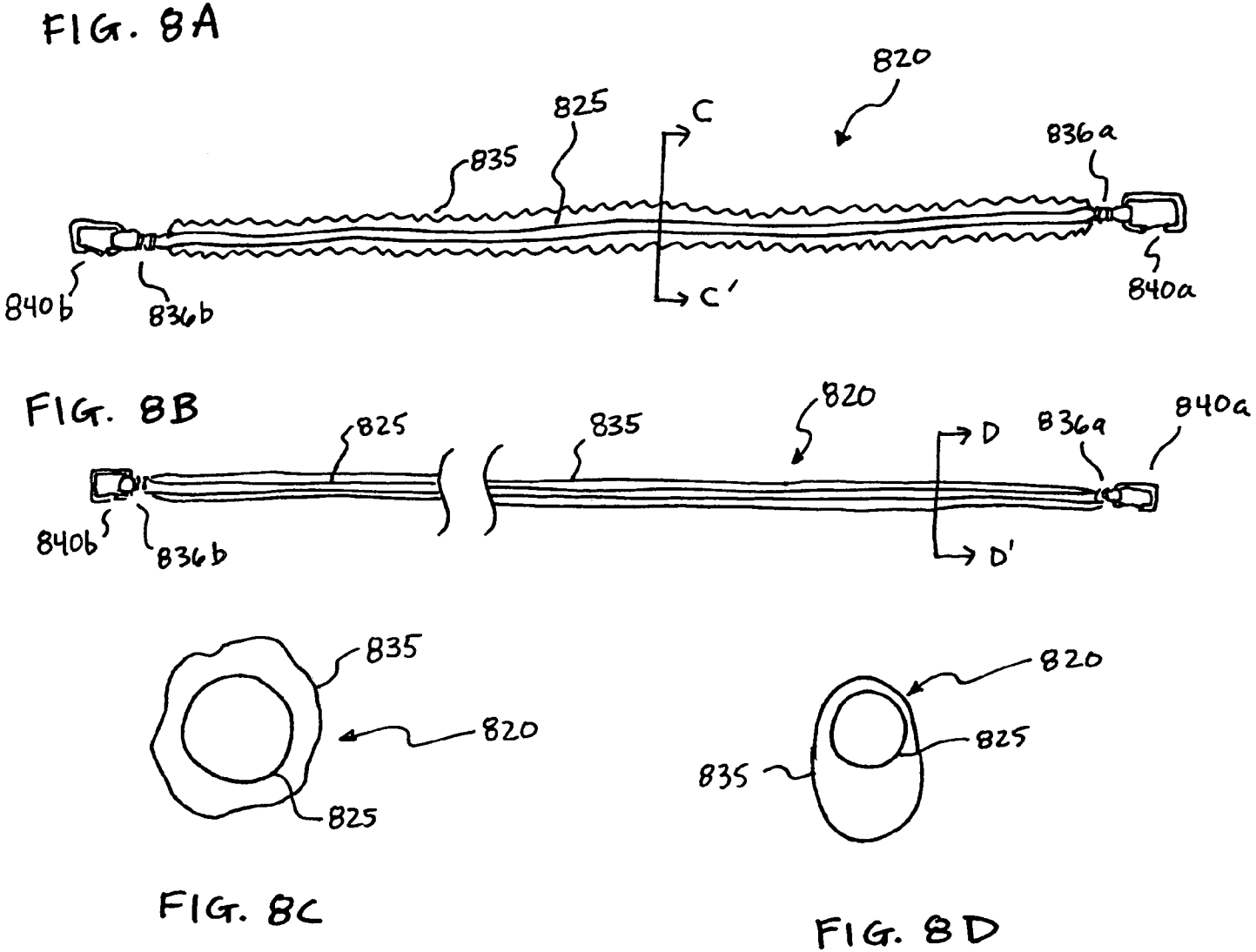
FIG. 8A is a perspective illustration of another embodiment of a towline in a first, relaxed state.
FIG. 8B is a perspective illustration of the towline of FIG. 8A in a second, extended state.
FIG. 8C is a cross-sectional elevation of the towline in the first, relaxed state of FIG. 8A
FIG. 8D is a cross sectional elevation of the towline in the second, extended state of FIG. 8B.

FIG. 8C is a cross-sectional elevation, taken at section line C-C' in FIG. 8A, showing the relative cross-sectional dimensions of the surgical tubing 825 and surrounding fabric cover 835, when the tubing is relaxed or not under tension. When the towline 820 is stretched, the cross sectional area of the surgical tubing decreases, with the bunching or gathering of the protective fabric cover diminishing, as shown in the corresponding cross-sectional elevation in FIG. 8D, taken at section line D-D' in FIG. 8B.

FIG. 9 illustrates a preferred embodiment of the hybrid towline 900 in perspective. The hybrid line 900 has carabiner clips 940*a* and 940*b* at opposing ends. The towline 900 comprises two sections, a first elastic or modulating line segment 910 is connected in parallel series to a static line segment 930 at point E. Static line segment 930 also connects in parallel to a substantially shorter lightweight elastic draw line segment 920 at the same point as the modulating segment, with the other end connected to the opposing end of the draw segment 920. At point E, the static line 930 is first connected to the modulating line 910, with the end of the draw line 920 then connected to the static line. Thus, the draw line segment 920 will stop extending when the static line segment 930 is fully extended, causing further strain to occur in modulating segment 910. The static segment 930 is held close to the draw segment 920 by the cover 950, illustrated in FIG. 9B. Details of the preferred method of connecting the modulating, draw and static line segment at point E are illustrated in FIG. 9E. The opposing ends of the draw line segment 920 and the static line segment 930 are connected to caribiner 940*a*, at point C. Details of the preferred method of connecting the draw and static line segment to the caribiner 940*a* at point C are illustrated in FIG. 9C. The opposing end of the modulating line segment 910 is connected to caribiner clip 940*b* at point D, as illustrated in further detail in FIG. 9D.

The modulating line segment 910 is typically natural latex tubing with an inner diameter of ¼" (6 mm) to 5/16" (8 mm) and a wall thickness of about 1/16" (1.6 mm) to ⅛" (3 mm) and is about 14" to 18" (360 to 450 mm) long. The static line segment 930 typically has a diameter of 1/16" (1.6 mm) to about ⅛" (3.2 mm) and is about 36" (0.9 m) to 48" (1.2 m) long. The draw line segment 920 is typically natural rubber latex tubing, having an inner diameter of about 5/32". (4 mm) and a wall thickness of about 3/64". (1.2 mm) to about 1/16" (1.6 mm). The draw line segment is 10". (250 mm) to about 14" (360 mm) long. Thus, the total length of the hybrid towline 900 in its relaxed state is between about 24" to and 32". Keeping the non-extended or relaxed length less than about 36" avoids having the loose end drag on the grounds when the other side is attached to a participant at the waist or hips. The combined elastic properties are such that during use of the hybrid towline 900, the more elastic lighter weight draw line segment 920 readily stretches to a comfortable length for separating the leader and the follower by about 5 to 6 feet (or about one 1.5 to 2 meters). When the leader needs to haul or provide significantly greater assistance to the follower the draw line segment will extend to a maximum length as limited by the full extension of the substantially non-elastic static line segment, or about 36 to 48". Thereafter, the less elastic heavier weight modulating line segment will gradually transfer stress to the follower, with the acceleration absorbed by the modulating line segment so that neither the leader nor the follower feels a jolt. The static line 930 typically has a diameter of 1/16 in. (1.6 mm) to about ⅛ in. (3.2 mm) and is about 36 in. (0.9 m) to 48 in. (1.2 m) long. The draw line is typically natural rubber latex tubing, having an inner diameter of about 5/32 in. (4 mm) and a wall thickness of about 3/64 in. (1.2 mm) to about 1/16 in. (1.6 mm). The draw line is 10 in. (250 mm) to about 14 in. (360 mm) long In the elevational cross-section of FIG. 9B, a protective fabric 950 covers and surrounds the combined length of the modulating line segment 910, draw line segment 920 and static line segment 930. A preferred form of a fabric covering is lightweight, durable, nonabsorbent, snag-resistant fabric such as NYLON tent fabric sewn into a tube on the fabric bias to provide more give in the direction of gathering or extension, the length of the tube being about 4 times the length of the hybrid towline 900 in its relaxed state, and the circumference of the tube being about 2 times the circumference of the surgical tubing. More preferably fabric cover 950 is a lightweight water resistant synthetic fabric such as "SUPPLEX", and has a circumference of about 2⅝ in. (70 mm) to about 3 in. (76 mm), and when fully extended is about 12 feet (3.7 meters) long.

Figure 9A:
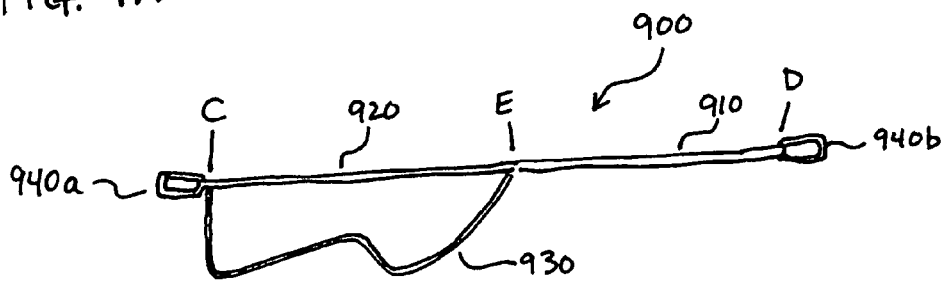
FIG. 9A is a perspective illustration of another embodiment of a towline, in a first relaxed state.
Figure 9B:
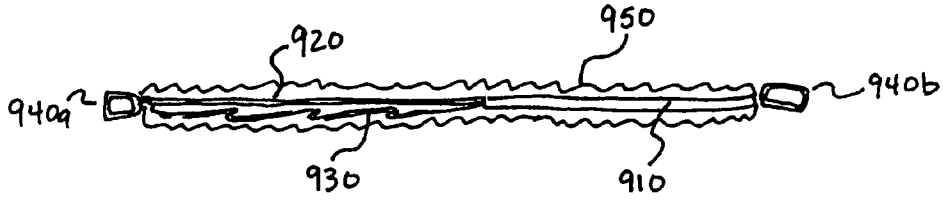
FIG. 9B is a cross-sectional elevation through the towline in FIG. 9A.
Figure 9C:
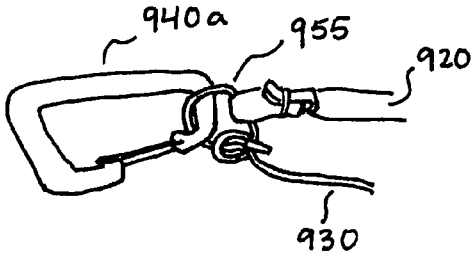
FIG. 9C is a perspective illustration of connection of the caribiner at point C in FIG. 9A.
Figure 9D:
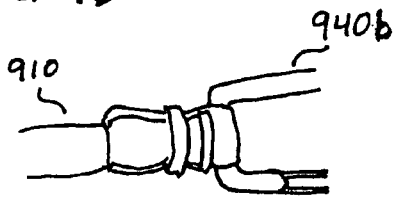
FIG. 9D is a perspective illustration of connection of the other caribiner at point D in FIG. 9A

FIG. 9C illustrates the attachment of the surgical tubing used to form draw line segment 920 to a loop 955 in the static cord 930 that commonly also attaches one end of the static line segment 930 to the carabiner clip 940*a*. Loop 955 is typically created using a bowline knot. Loop 955 is readily inserted or removed by opening the carabiner clip in the usual manner. The static line 930 end is attached to loop 955 using a bowline knot. The end of the surgical tubing draw segment 920 is attached to loop 955 by forming another loop as shown in FIGS. 9F and 9G. A half section of the tubing about 1/2 in. (12 mm) to 3/4 in. (18 mm) is cut away from the end to be looped as shown in FIG. 9F. Next, as shown in FIG. 9G, the end of the tubing is double folded to leave a loop, with the cut away end being placed onto the tubing just after the loop. The two and a half layers of tubing adjacent the loop portion are then secured together by wrapping them with fasteners such as cable ties, "NYLON" twine, metal crimps and the like. The double fold ensures that tension on the loop does cause the folded over portion to slip out of the fasteners.

Figure 9E:
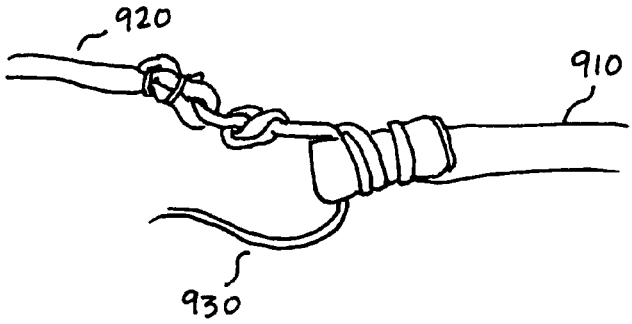
FIG. 9E is a perspective illustration of the connection of the modulating, draw and static line segment at point E in FIG. 9A.
Figure 9F:
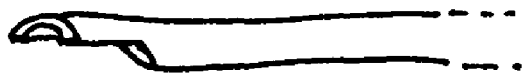
FIG. 9F, G and H illustrate the steps in connecting the carabiner in FIG. 9C.
Figure 9G:
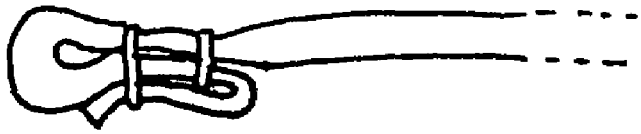
Figure 9H:
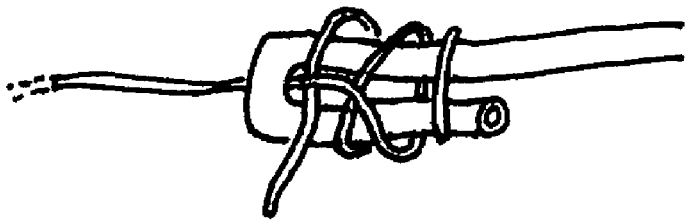

FIG. 9E illustrates how the opposite end of the draw line segment is formed into a loop, as shown in FIG. 9G, so that it can be connected to the opposite end of the static line segment 930 with bowline knot. However, before the opposing end of the static line segment 930 is connected to the adjacent portion of the draw line segment 920, the end of static line segment 930 passes through a loop formed in the end of the modulating line segment 910. As shown in FIG. 9H, at point E a double sheet bend knot secures draw line segment 930 to the folded over end of modulating line segment 910.

Despite the deployment in difficult terrain, an interpersonal towing system deploying the towline of FIG. 7-9 is robust, as the protective cover enhances the durability of the rubber towline.

Figure 10:
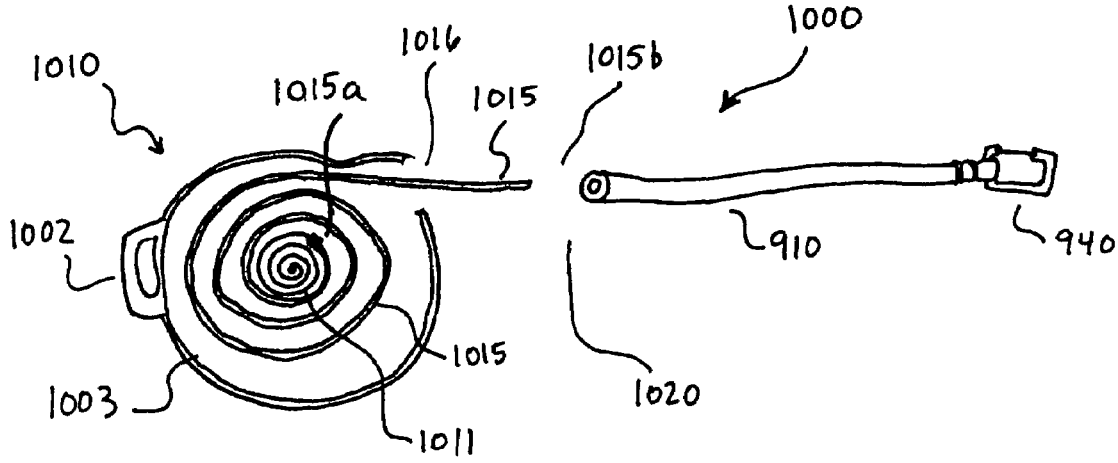
FIG. 10 is a partial cut-away view of another embodiment of a towline in a first partially relaxed state.

FIG. 10 is a partial cut-away view of another embodiment of a towline 1000 in a first partially relaxed state. Towline 1000 comprises a commercially available retractable dog leash 1010, which in turn comprises a case 1003 in which a first end 1015*a* of a flexible line or cord 1015 is attached to a spirally wound inner coil of thin metal strip 1011. Hybrid line 1020 comprises flexible line or cord 1015, which acts as a static segment 1015 attached at end 1015*a* a modulating segment, 910, described with reference to FIG. 9. The static segment 1015 and modulating segment 910 are attached with a double sheet bend knot illustrated in FIG. 9H. The opposing end of modulating segment 910 is attached to a carabiner clip 940 as in FIGS. 9D, F, and G. Hybrid segment 1020 emerges from case 1003 through opening 1016. The case 1003 has an exterior loop 1002. The loop is readily attached to any embodiment of the harnesses described herein by a carabiner. The inner coil 1011 acts a spring to retract the line when there is no tension on the line. The flexible static segment 1015 is preferably 1/16" diameter "NYLON" cord, typically about 41" long. It will be appreciated that towline 1000 is highly compact in its relaxed state while affording all of the functionality and convenience of hybrid towline 900. Further, the spirally wound thin metal strip 1011 unwinds under light force. Thus, the static segment 1015 reaches its fully extended state at a towing force of approximately 1 KG, allowing the leader and the follower to achieve a comfortable following distance when the leader is exerting only a very light towing force.

Figure 11A:
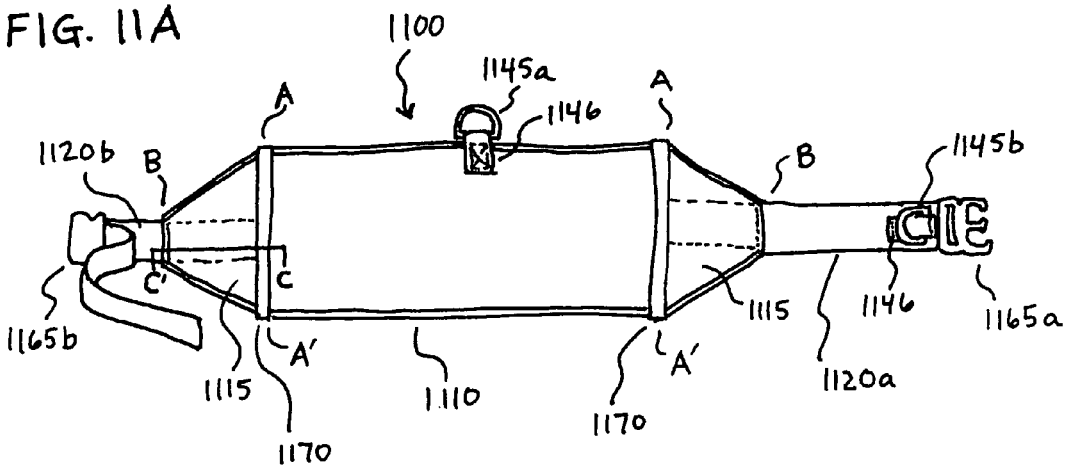
FIG. 11A is an elevation view of one embodiment of a butt/hip-hugging harness.

FIG. 11A is an elevation view of one embodiment of a hip or butt-hugging harness 1100. Reference character B indicates the region of the harness shown in the fragmentary elevation in FIG. 11B, whereas section line C-C' refers to FIG. 11C. The butt/hip-hugging harness 1100 comprises rear panel 1110, substantially triangular end panels 1115 and belt portions 1120*a* and 1120*b*. The belt 1120 is preferably formed from durable "NYLON" fabric webbing and has a width of about 2". A first D-ring 1145*a* is attached to the center top edge of rear panel 1110 by fabric strip 1146, which is stitched directly to rear panel 1110. A second D-ring 1145*b* is attached to the belt 1120*a* by another sewn strip of "NYLON" fabric webbing 1146. One or two D-rings may be deployed at the above locations, although two are preferred so that the leader or follower can use the same harness.

The rear or central fabric panel 1110 of harness 900 is optionally formed from "NEOPRENE" closed cell rubber foam fabric, which is cut at the proper bias so that its more elastic axis is aligned on the user in the vertical direction the harness provides the maximum stability on the leaders or followers hips while running. Side panels 1115 have a triangular or trapezoid shape with the shorter of the two parallel edges of the trapezoid substantially the same length as the width of the belt portion 1120. The belt portion 1120 is preferably stitched to the side panels 1115, spanning from the wider base of the trapezoid, side A-A', where it is also stitched to the rear panel, to the narrower top at the opposing end of the trapezoid shape. Buckle 1165, has a first half 1165*a* attached to the terminal end of belt portion 1120*a* and a second half 1165*b* attached to the terminal end of belt half 1120*b*. Buckles 1165 are conventional types formed from plastic that snap together. The buckles 1165*a* and 1165*b* are also attached to the belt 1120 in a manner that permits the adjustment of the total length of the belt portion, and hence allows the harness 1110 to fit different users.

Figure 11B:
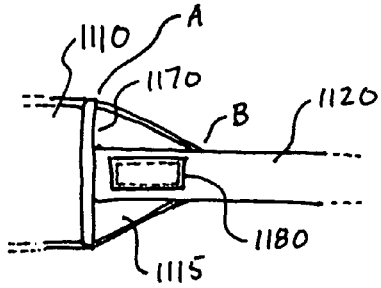
FIG. 11B is a fragmentary view of an inner portion of the butt/hip-hugging harness of FIG. 11A.
Figure 11C:
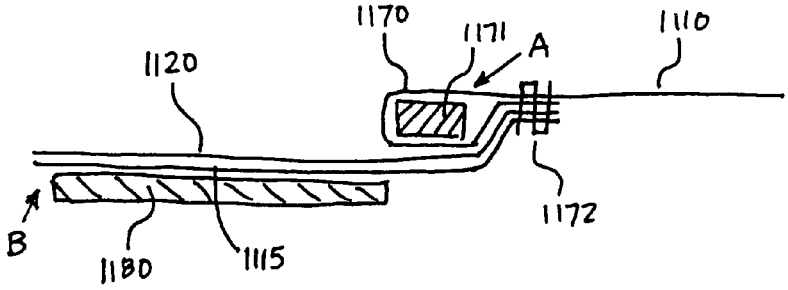
FIG. 11C is a cross sectional elevation of a portion of the butt/hip-hugging harness of FIG. 11B.

FIG. 11C is cross section of the harness 1110 at reference line C-C' in FIG. 11A showing further detail of the construction of the union between the rear panel and the side panels along the line between reference points A-A'. The side edges of rear panel 1110, at A-A', are stitched to the side of each of the two ends panels 1115, as shown in FIG. 11C. The end panels 1115, belt 1120 and rear panel 1110 are all stitched together by thread stitching 1172. However, a portion of the edge of the rear panel is folded over before stitching to form sleeve 1170. The sleeve 1170 contains a semi-rigid plastic strip 1171 that extends substantially from about A to A'. The semi-rigid plastic strip acts as a stiffening rib to maintain the lateral spread of the rear panel portion 1110. Although it is not shown, the portions of the belt 1120 that overlays the side panels 1115 are preferably stitched together to side panels 1115 over the width of the belt.

FIG. 11B is a fragmentary view of an inner portion of the hip or butt/hip-hugging harness of FIG. 11A to illustrate how a small patch of "NEOPRENE" fabric 1180 is sewn over the stiffer plastic mesh fabric panels to help keep the harness in place on the user's hips.

Figure 12A:
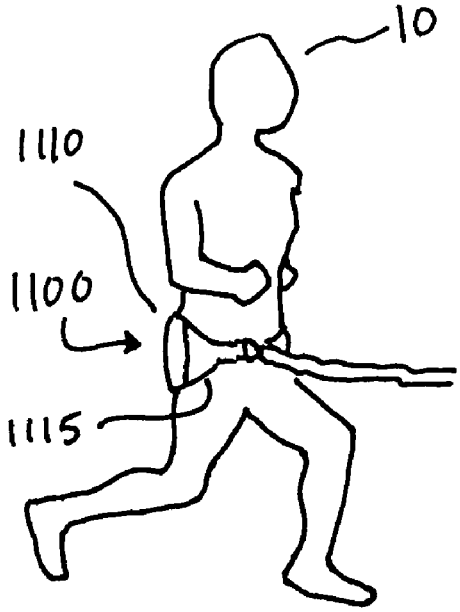
FIG. 12A is a front perspective view of a follower running while wearing the butt/hip-hugging harness of FIG. 11.
Figure 12B:
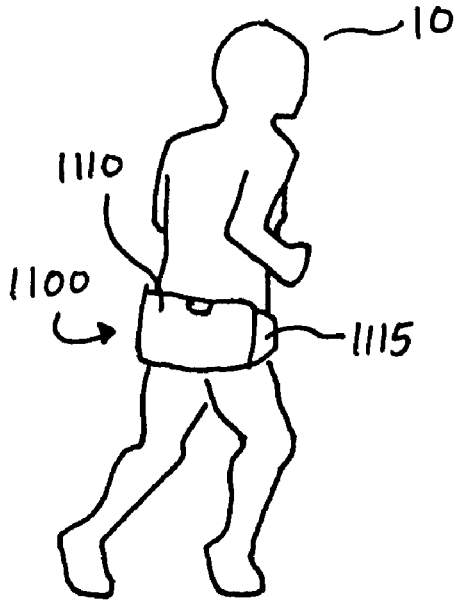
FIG. 12B is a rear perspective view of a follower running while wearing the butt/hip-hugging harness of FIG. 11.

In alternative embodiments of the butt/hip-hugging harness, the rear panel is optionally fabricated from a lighter weight, with respect to "NEOPRENE", fabric such as "NYLON" fabric for breath ability and lighter weight. Preferably for maximum stability on the wearer's hips the back panel is fabricated from an elastic fabric, such as "NEOPRENE" foamed rubber sheets, which can be combined or laminated with other fabrics FIG. 12A is a front perspective view of a follower running while wearing the butt/hip-hugging harness 1100 of FIG. 11. FIG. 12B is a rear perspective view of a follower running while wearing the butt/hip-hugging harness 1100 of FIG. 11. Note that the harness is worn low on the hips so that the pulling force is applied to the pelvis and not the lumbar spine.

Figure 13A:
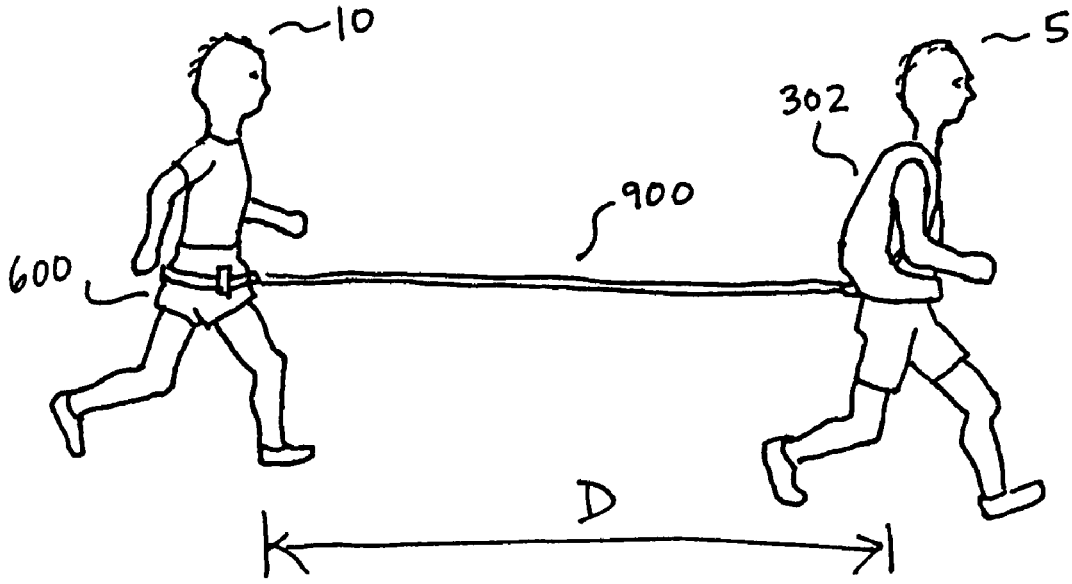
FIG. 13A is a side perspective view of a leader and follower running while wearing the harnesses of FIG. 3 and FIG. 6 respectively.
Figure 13B:
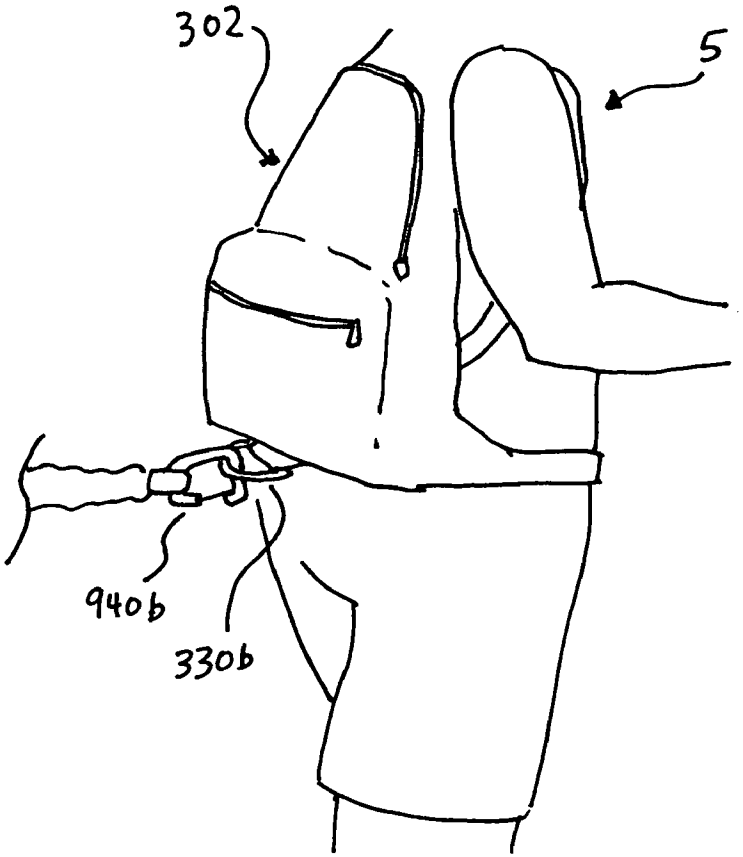
FIG. 13B is a perspective view showing in more detail the connection of the towline the follower and the leader.
Figure 13B:
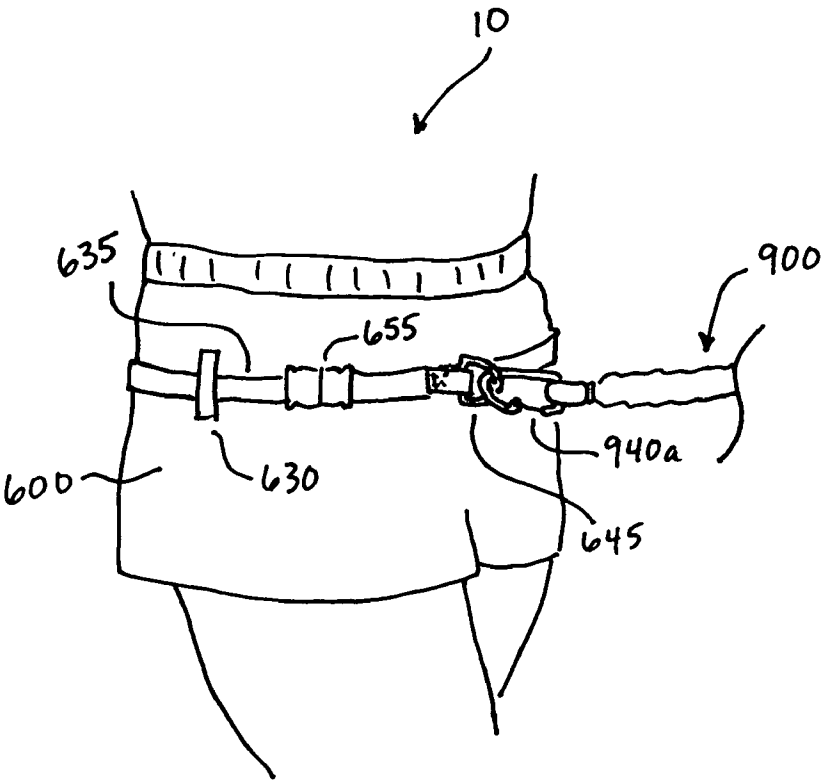

FIG. 13 is a side perspective view of a leader and follower running while wearing the harnesses of FIG. 3 and FIG. 6 respectively being separated by a distance, D. The elastic hybrid towline 900 readily stretches to a length of at least about 6 feet when the forward runner exerts a force of at least 3 kilograms on the following runner, as the total strain in the towline will be at least about 200%, stretching hybrid towline 900 to approximately twice its relaxed length.

It should be appreciated that the use of elastic tubing is not intended as the only embodiment of the invention, as elastic members formed of different materials or different cross-sections can be deployed with success.

While the invention has been described in connection with a preferred embodiment, it is not intended to limit the scope of the invention to the particular form set forth, but on the contrary, it is intended to cover such alternatives, modifications, and equivalents as may be within the spirit and scope of the invention as defined by the appended claims.

The invention claimed is:

1. An interpersonal towing system comprising:

a) a first harness, with at least one of a front and a rear towline connection loops, b) a second harness, with at least one of a front and a rear towline connection loops, c) a towline detachably connected at a first end to the rear connection loop of one of said first and second harnesses, and detachably connected at the second end to the front connection loop of the other harness, d) wherein said towline comprises:

i) a first elastic section having a free end and a connected end, ii) a static section having a free end and a connected end, wherein the connected end is attached to the connected end of said first elastic section, iii) a second elastic section having a first end connected to the free end of said static section and the second end connected to the connected end of said static sections, iv) a first latching clip attached to the free end of said first elastic section, v) a second latching clip attached to the free end of said static section.

2. An interpersonal towline according to claim 1 wherein said highly elastic towline has a length of about less than about 3 feet when relaxed.

3. An interpersonal towline according to claim 2 wherein said highly elastic towline extends to at least twice its relaxed length under a force of about 3 kilograms.

4. An interpersonal towing system according to claim 1 wherein at least one of the first and second harness is substantially stabilized on the wearer by an inward facing layer of elastic or tacky material disposed on inner surface thereof so that the front and rear connection loop remain at about upper pelvis level independent of the difference in elevation between the persons wearing the first and second harnesses.

5. An interpersonal towing system according to claim 1 wherein at least one of the first and second harness is a backpack.

6. An interpersonal towing system according to claim 1 wherein at least one of the first and second harness is a fanny pack.

7. An interpersonal towing system according to claim 1 wherein at least one of the first and second harness is a pants garment.

8. An interpersonal towing system comprising:

a) a first harness, with at least one of a front and a rear towline connection loops, b) a second harness, with at least one of a front and a rear towline connection loops, c) a towline detachably connected at a first end to the rear connection loop of one of said first and second harness, and detachably connected at the second end to the front connection loop of the other harness, d) wherein said towline further comprises;

i) at least one elastic section having a free end and a connected end, ii) a static section having a free end and a connected end, wherein the connected end is attached to the connected end of said first elastic section, iii) a second elastic section having a first end connected to the free end of said static section with the other end attached to the connected end of said static section, iv) means for retraction upon disconnection from the loop of either harness.

9. An interpersonal towing system according to claim 8 wherein said means for retracting comprises a container for retracting at least a portion of the towline by coiling within said container.

10. An interpersonal towing system comprising:

a) a first harness, with at least one of a front and a rear towline connection loops, b) a second harness, with at least one of a front and a rear towline connection loops, c) a towline detachably connected at a first end to the rear connection loop of one of said first and second harness, and detachably connected at the second end to the front connection loop of the other harness, d) wherein said towline further comprises means for retracting upon disconnection from the connection loop of the other harness e) wherein at least about a 6 foot portion of the line extends from the retracted state when a force of about 1 kilogram is applied.

11. An interpersonal towline comprising, a) a first elastic section having a free end and a connected end, b) a static section having a free end and a connected end, wherein the connected end is attached to the connected end of said first elastic section, c) a second elastic section having a first end connected to the free end of said static section with the other end attached to the connected end of said static section, d) a first latching clip attached to the free end of said first elastic section, e) a second latching clip attached to the free end of said static section.

12. An interpersonal towline according to claim 11 further comprising a fabric covering that extends between said first and second latching clips to enclose each of said static segment, said first elastic section and said second elastic section.

13. An interpersonal towline according to claim 11 wherein said first and second elastic sections have a combined length of not more than about 3 feet when relaxed.

14. An interpersonal towline according to claim 13 wherein said first and second elastic sections extend to a total length of at least about 6 feet when a force of about 3 kilograms is applied.

15. An interpersonal towline according to claim 14 further comprising a fabric covering that extends between said first and second latching clips to enclose each of said static segment, said first elastic section and said second elastic section.

* * * * *